United States Patent [19]

Parker et al.

[11] 4,212,398

[45] Jul. 15, 1980

[54] PARTICLE SEPARATING DEVICE

[75] Inventors: Ralph M. Parker, Redding; James H. Mock, Ceres, both of Calif.

[73] Assignee: Pet Incorporated, St. Louis, Mo.

[21] Appl. No.: 934,092

[22] Filed: Aug. 16, 1978

[51] Int. Cl.[2] ..... B07C 5/00

[52] U.S. Cl. ..... 209/590; 209/599; 209/639

[58] Field of Search ..... 209/590, 599, 600, 644, 209/639; 324/80; 73/67.2

[56] References Cited

U.S. PATENT DOCUMENTS

| | | | |
|---|---|---|---|
| 3,004,662 | 10/1961 | Armstrong et al. | 209/599 |
| 3,127,016 | 3/1964 | Baigent | 209/599 |
| 3,394,806 | 7/1968 | Vaillette | 209/111.9 |
| 3,559,805 | 2/1971 | Cragg et al. | 209/599 |
| 3,675,660 | 7/1972 | Girodat | 209/599 |

*Primary Examiner*—Allen N. Knowles

*Attorney, Agent, or Firm*—Gravely, Lieder & Woodruff

[57] ABSTRACT

Comingled particles, such as nut meats and shell fragments, are segregated by directing the particles one after the other onto a sounding plate, from which they deflect into a rebound trajectory. Each particle upon striking the plate imparts ultrasonic vibrations to the plate, and these vibrations are converted by a transducer into an electrical input signal that oscillates at the frequency of the vibrations and undergoes corresponding changes in amplitude. After amplifying the input signal and filtering low frequency signals from it, a comparator converts those original oscillations which exceed a predetermined threshold amplitude into voltage pulses that are counted in a counter. If the count exceeds a minimum set into the counter, the counter produces a signal itself. This signal initiates an output signal of predetermined duration, which after undergoing a delay, operates an air valve that is connected with an air nozzle located along the rebound trajectory. As a result, an air blast issues from the nozzle. The delay is such that the air blast occurs just when the particle that caused it is opposite the nozzle, so that the air blast deflects the particle out of the rebound trajectory and into a reject trajectory. On the other hand, oscillations in the input signal that exceed another and higher threshold amplitude may be converted into pulses which themselves initiate the output signal without being counted. In this instance the signal that is produced overrides the output signal derived from the counter and is of longer duration, so that a longer air blast occurs. This air blast is normally of sufficient duration to deflect the heavier particles into the reject trajectory.

18 Claims, 4 Drawing Figures

PARTICLE SEPARATING DEVICE

BACKGROUND OF THE INVENTION

This invention relates in general to the segregation of comingles discrete solid substances and more particularly to a process and apparatus for segregating such substances on the basis of vibrations they induce in a sounding plate.

Many processes exist for separating comingled solid substances of relatively small particle size, but most do not possess a high measure of reliability and therefore must be supplemented with visual inspection an expensive and tedious procedure. For example, in the food nut industry, nut cracking machines yield a mixture of nut meat and shell fragments. The former has value as a food product and is packaged and sold. The latter has little value and is often discarded. In any event, to produce a saleable product, the nut meat must be segregated from the shell fragments and any other foreign material. Under current practices most of the separation is achieved with aspirators that withdraw light weight shell fragments and shaker-graders that are actually screening devices which remove most of the high density shell fragments. Even so, the resulting product still contains 10% to 15% shell fragments. This product passes over a so-called picking table where individuals manually pick out the remaining shell fragments as well as any inferior nut meat. This is a tedious procedure and does not afford ample opportunity for those who perform it to concentrate on the quality of the nut meat.

SUMMARY OF THE INVENTION

One of the principal objects of the present invention is to provide a process and an apparatus for segregating particles having different characteristics on the basis of vibrations such particles impart to a plate against which they impinge. Another object is to provide a process and an apparatus of the type stated which are highly reliable. An additional object is to provide a process and an apparatus of the type stated which are ideally suited for separating food products from foreign matter, and particularly for segregating nut meat from shell fragments. These and other objects and advantages will become apparent hereinafter.

The present invention is embodied in an apparatus for segregating comingled solid particles, which apparatus comprises a sounding plate against which the particles are directed, means for converting the vibrations imparted to the plate by the particles into an input signal that oscillates at the same frequency as the vibrations and undergoes corresponding changes in amplitude, and means for analyzing the input signals and for producing an output signal which distinguishes those output signals that have a prescribed number of oscillations exceeding a threshold amplitude from those that do not. The invention further resides in the process that is employed by the apparatus. In addition, the invention resides in a machine that utilizes ultrasonic vibrations imparted to a sounding plate for segregating the particles. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
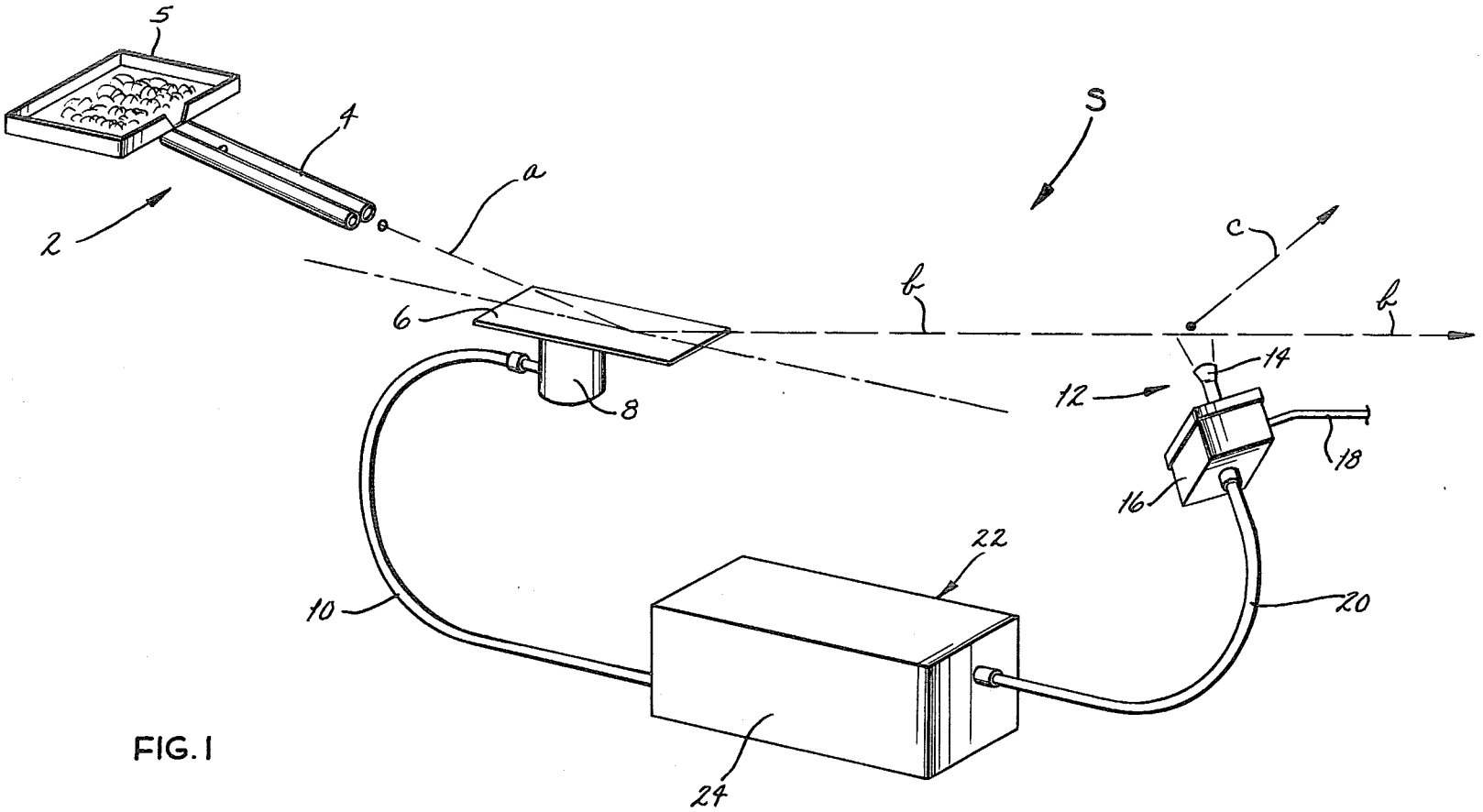
FIG. 1 is a schematic perspective view of the segregating apparatus illustrating its various components.

Referring now to the drawings, a segregating apparatus S (FIG. 1) is useful for segregating commingled particles of relatively small size on the basis of the density and resiliency of such particles, as well as any other characteristics which affect the vibrations those particles set up in the object they strike. The machine S is particularly useful in the food industry for segregating nut meat from shell fragments after the food nuts are cracked to expose the nut meat. Normally it is located in the production line beyond normal separating devices such as aspirators and shaker-graders, yet before the picking table. Irrespective of the particular food nut that is processed, the density and resiliency of the nut meat are different from the density and resiliency of the shell fragments and the two will impart ultrasonic vibrations of entirely different character to the objects they strike. The apparatus S relies on this characteristic to segregate.

The apparatus S includes (FIG. 1) a feed device 2 having counterrotating rolls 4 that are inclined downwardly and a vibrating tray 5 at the upper ends of the rolls 4. The tray 5 discharges nut meat and shell fragments, that is the particles, into the trough between the two rolls 4. The rolls 4 organize the commingled particles into a single row so that they advance along the rolls 4 one after the other. Upon reaching the lower ends of the rolls 4, the particles are discharged and fall through a downwardly inclined approach trajectory a.

Located along the approach trajectory a is a sounding plate 6 which is flat and is oriented such that the included angle between the approach trajectory a and the plate 6 is between 5° and 25° and is preferably about 11°. The plate 6 should be at least $\frac{3}{4}$ inches wide and good results have been obtained with a rectangular stainless steel plate measuring $1\frac{1}{2}'' \times 2'' \times \frac{1}{4}''$. The particles ricochet off the flat upper surface of the plate 6 and leave it along a rebound trajectory b. Preferably the plate 6 is also inclined with respect to the horizontal so that the particles tend to glance off of its upper surface. In this regard, good results have been obtained when the rolls 4 are inclined between about 15° and 45° and the plate 6 is inclined between about 5° and 25°. Also the particles should preferably strike the plate 6 nearer its end that is farthest from the feed device 2.

Upon striking the sounding plate 6, the particles impart vibrations to the plate 6 and some of these vibrations are in the ultrasonic region, ranging between 20,000 and 200,000 hertz. The ultrasonic vibrations radiate from the point of impact and travel primarily along the surface of the plate 6. The vibrations induced by nut meat differ significantly from those induced by shell fragments, irrespective of the type of nut, with the differences being in frequency, amplitude, and decay. Shell fragments impart vibrations of higher frequency and higher amplitude than do nut meat particles, and decay less rapidly. The decay, that is the decrease in amplitude with time, is termed "ringdown". Vibrations caused by nut meats have a shorter ringdown time than those caused by shell fragments or most other foreign particles such as metal, glass, and the like.

Figure 2:
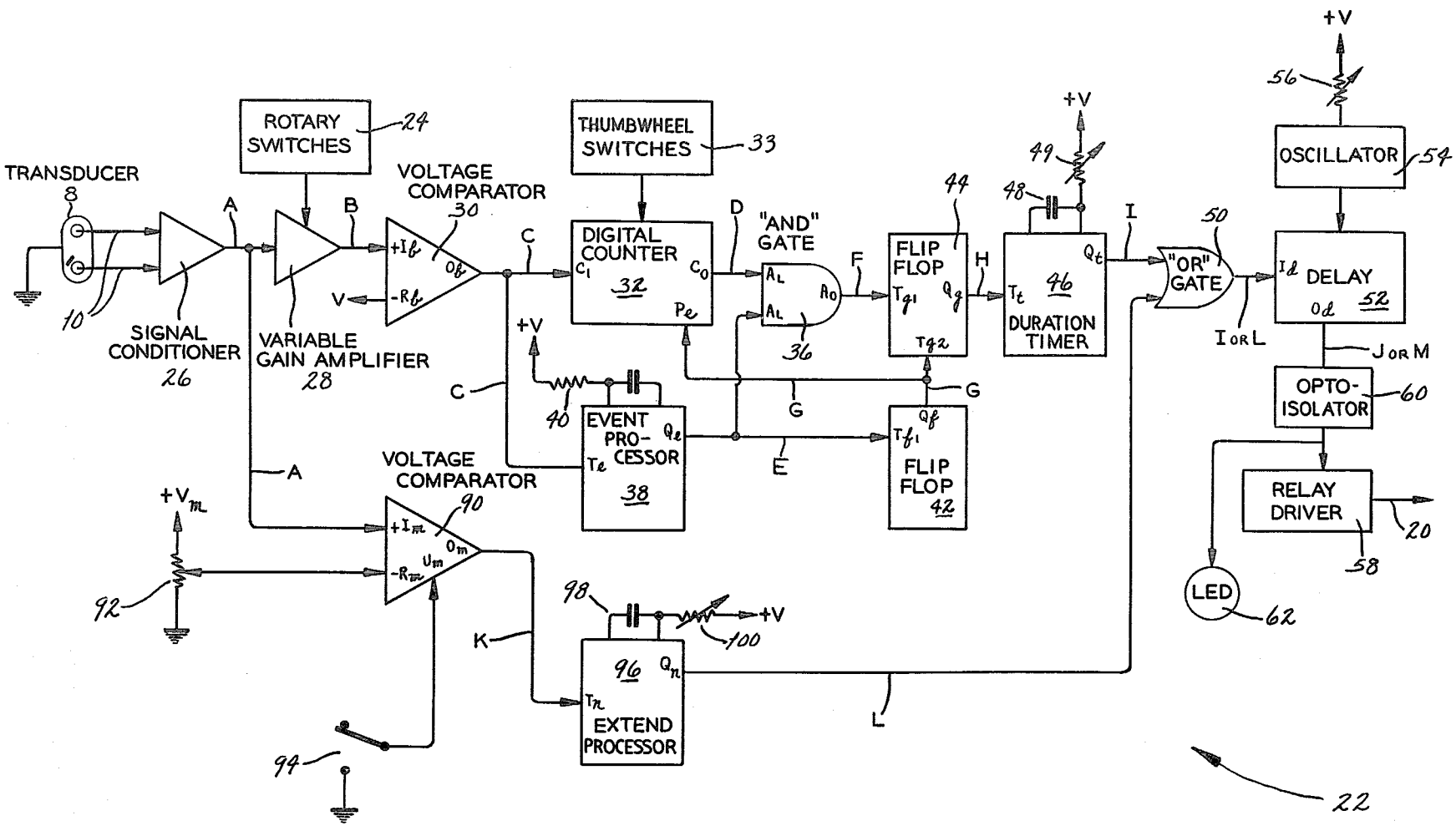
FIG. 2 is a block diagram of the control unit for the segregating apparatus.

The vibrations in the plate 6 are detected by a transducer 8 (FIG. 1) which is located on the underside of the plate 6, preferably at the end opposite the location where the particles strike the plate 6. The transducer 8 includes a crystal that operates on the piezoelectric principle in that it converts the vibrations at the plate 6 into an oscillating electric signal. Preferably the crystal is barium titanate, for this crystalline material exhibits a relatively constant gain over the ultrasonic range of frequencies induced in the plate 6. The crystal is bonded to the underside of the plate 6 by a bonding agent which affords substantially complete and undistorted transmittance of the acoustic waves induced by the particles. Silicon-based adhesives, such as General Electric adhesive 54003, which cure to a pliant layer having good transmittance properties, are well suited for the purpose. Since the transducer 8 operates on the piezoelectric principle, its crystal absorbs the acoustic waves that are transmitted to it and converts those waves into electrical waves of equal frequency and generally proportional amplitude. In other words, the crystal of the transducer 8 converts the ultrasonic acoustic vibrations into an electrical input signal. Actually, the transducer 8 has three leads connected to it (FIG. 2), one being a common ground and the other two being isolated from each other and from the ground. All three leads beyond the transducer 8 are embodied in a coaxial cable 10, with the ground being a metal shield surrounding the other two leads. This shield shunts all transient voltages and outside interference to ground.

The segregating apparatus S further includes a reject device 12 (FIG. 1) located along the rebound trajectory b for deflecting particles out of the rebound trajectory b and into a reject trajectory c. The reject device 12 may constitute an air nozzle 14 located along the rebound trajectory b and oriented transversely to that trajectory, so that a blast of air issuing from the nozzle 14 will deflect particles out of the rebound trajectory b and into the reject trajectory c. The nozzle 14 is positioned on an air valve 16 which in turn is connected to a source of high pressure air through a high pressure air line 18. The air valve 16 is electrically operated by current supplied through a drive cable 20.

In addition to the foregoing, the apparatus S includes a control unit 22 (FIG. 1) to which both the coaxial cable 10 extending from the transducer 8 and the drive cable leading to the air valve 16 are connected. The control unit 22, which is contained in a housing 24, analyzes the input signals derived from the transducer 8 and energizes the air valve 16 in response to those signals which meet certain criteria as to frequency, amplitude, and ringdown time. Stated differently, as to each signal derived from the transducer 8, which signal represents a single particle striking the sounding plate 8, the control unit 22 determines whether the signal possesses sufficient frequency, amplitude and adequate ringdown time to qualify as a nut meat or a shell fragment, and if the latter, it energizes the air valve 16 at the precise instant that the shell fragment is over the air nozzle 14, so that the air issuing from the nozzle 14 will deflect the shell fragment out of the rebound trajectory b and into the reject trajectory c.

The control unit 24 includes (FIG. 2) a signal conditioner 26 which is connected to the coaxial cable 10 to receive the weak input signal generated by the crystal of the transducer 8 in response to a particle striking the sounding plate 6. The conditioner 26 contains both a differential amplifier and a filter. The former amplifies the input signal by a predetermined magnitude which may be 20 decibels. Furthermore, the output of the differential amplifier reflects only those signals in the two isolated input leads which precisely correspond with each other. In this manner the differential amplifier rejects unwanted electrical noise, such as electrical transients generated by AC equipment. The filter of the signal conditioner 26 is a plug-in type high pass filter which passes only those components of the input signal having frequencies in excess of 20,000 hertz. Thus, the analogue signal A emerging from the signal conditioner 26 represents the original signal amplified by a factor of 20 decibels and contains only those frequencies of the original signal that exceed 20,000 hertz. (FIG. 3).

The analogue signal A derived from the signal conditioner 26 passes into a variable gain amplifier 28, where it is normally amplified still further to emerge as an amplified analogue signal B (FIG. 3). the amplifier 28 is connected with a rotary switch 29 located at the exterior of the housing 24, and that switch controls the gain produced by the amplifier 28, making it adjustable in increments, so as to render the amplified analogue signal B compatible with and capable of being analyzed by other components in the control unit 22. A suitable range of amplification for the variable gain amplifier 28 is 0 to 60 decibels with the increments within the range being one decibel. The variable gain characteristic of the amplifier 28 enables the control unit 22 to analyze signals having wide variations in amplitude and frequency and thus expands the usefulness of the apparatus S beyond a particular type of food nut. Indeed, the variable gain characteristic serves to render the apparatus S suitable for segregating the shell fragments and nut meats of a wide variety of nuts.

The amplified analogue signal B from the variable gain amplifier 28 passes into a voltage comparator 30 having an input terminal $I_b$ to which the analogue signal B is applied, an output terminal $O_b$ at which a conditioned signal C appears, and a reference terminal $R_b$ to which a constant reference or threshold voltage V is applied. The comparator 30 compares the analogue signal B with the fixed reference or threshold voltage V applied at the terminal $R_b$, and further converts the signal B into a succession of pulses which appear at the output terminal $O_b$, there being a separate pulse for each time the signal B exceeds the threshold voltage V (FIG. 3). In this regard, the signal B received by the comparator 30 oscillates between a positive voltage and a negative voltage with the oscillations being of equal duration, and thus may be defined in terms of a frequency. While the oscillations are of equal duration, they are not of equal amplitude, but instead build up rather rapidly, then decay somewhat more slowly. The progressive decrease or decay in amplitude represents the so-called ringdown of the analogue signal B. A suitable threshold voltage V for the comparator is 1 volt DC. To enable the comparator 30 to evaluate the amplified analogue signal B, the variable gain amplifier 28 is adjusted so some of the peaks of the signal B derived from shell fragments exceed the threshold voltage V. Normally the output terminal $O_b$ of the comparator 30 exists at a neutral state, but each time the amplified input signal B applied to the input terminal $I_b$ of the comparator 30 exceeds the threshold voltage V, the output terminal $O_b$ of the comparator 30 changes condition and produces a separate pulse. Each excursion to the high state constitutes a separate pulse. In short, the comparator 30 converts the amplified analogue signal B into a digital signal that contains a pulse for each peak of the signal B which exceeds the threshold voltage V. The succession of pulses, if any, derived from the comparator 30 is termed a conditioned signal C.

Figure 3:
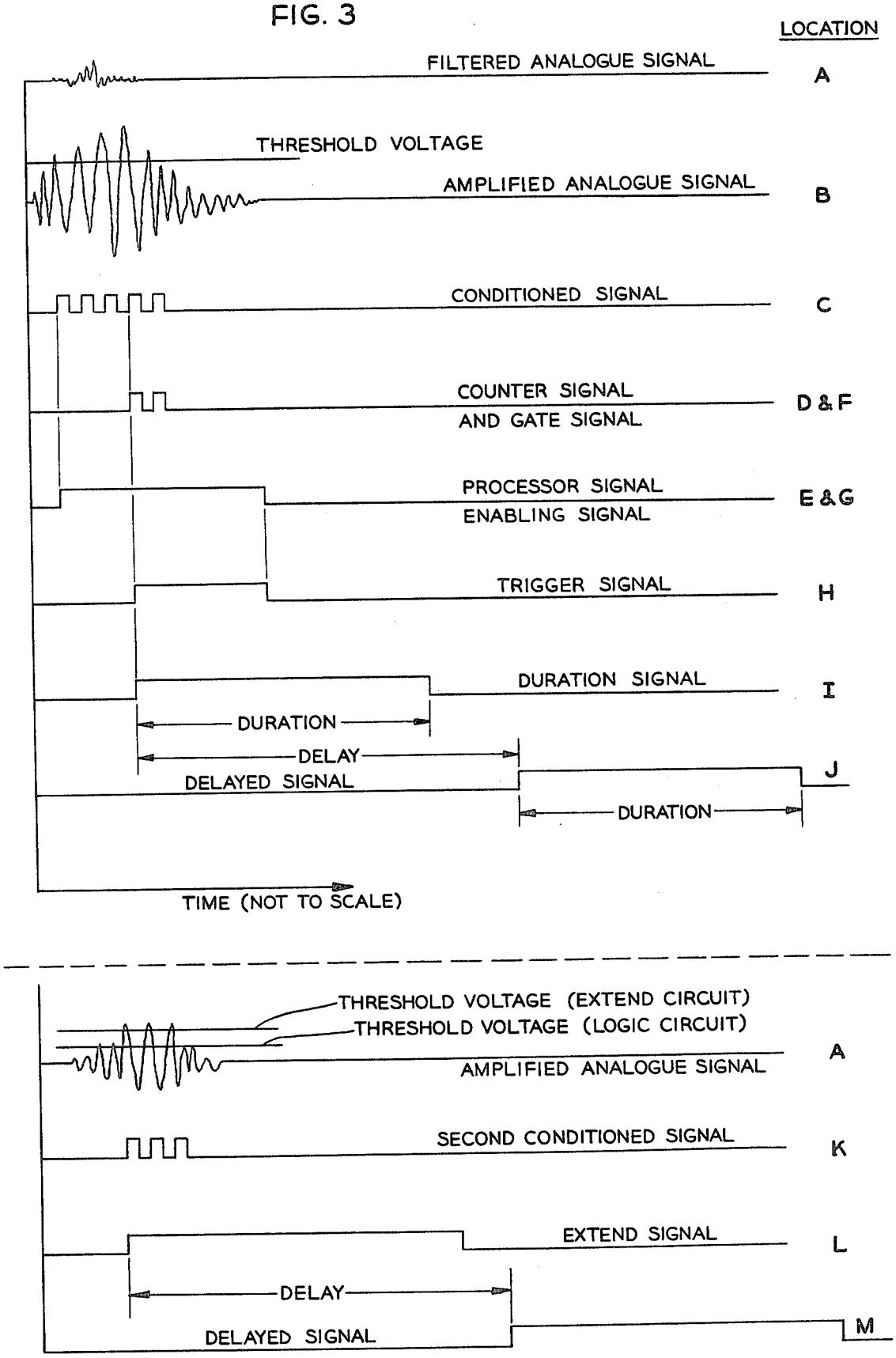
FIG. 3 is a graphic illustration of various signals that occur within the electronic circuitry of the control unit for the apparatus, and the chronological relationship between those signals.

The conditioned signal C from the comparator 30 passes into a digital counter 32 which counts the number of pulses, if any, in that signal, and when the pulses exceed a predetermined minimum, the counter 32 produces a signal D of its own (FIG. 3). In this regard, the counter 32 has an input terminal $C_1$ to which the conditioned signal C is applied, an output terminal $C_o$ where the counter signal D, if any, appears, and a reset terminal Pe. In order for the counter 32 to provide a count of the pulses in the conditioned signal C, an enabling signal must exist at the reset terminal Pe. Once the enabling signal is lost, the counter 32 resets itself. Thus, between successive counter signals D, the enabling signal must disappear momentarily from the reset terminal Pe. Coupled with the counter 32 are thumbwheel switches 33 which, when rotated, vary the count at which the counter 32 will provide its count or signal D. The switches 33, like the rotary switches 29 of the amplifier 28, are exposed at the exterior of the housing 24 and also serve to render the apparatus S suitable for segregating shell fragments and nut meat of a wide variety of nuts.

Normally, no signal exists at the output terminal C of the counter 32, but when the count in the conditioned signal C exceeds the predetermined number established by the counter switches 33, the output terminal C of the counter 28 changes condition and provides the counter signal D (FIG. 3), which is in effect a series of pulses. These pulses correspond to those pulses of the counter signal D which exceed the predetermined count set into the counter 32 (FIG. 3).

The output terminal C of the counter 32 is connected with an "and" gate 36 at one of two input terminals $A_L$ thereon. Consequently, when the counter 32 detects the requisite number of pulses in the conditioned signal C, the counter signal D it supplies to the "and" gate 36 represents one of two signals necessary for triggering the "and" gate 36. In this regard, the "and" gate 36, in addition to its two input terminals $A_L$ has a single output terminal $A_o$ which normally does not carry a signal. However, when corresponding signals are applied to both of the input terminals $A_L$, the output terminal $A_o$ produces a signal which remains for as long as both input terminals $A_L$ simultaneously carry signals. Since the counter signal D pulses, any signal from the "and" gate 36 will likewise pulse.

The conditioned signal C that emerges from the comparator 30, in addition to passing into the digital counter 32, also passes to an event processor 38 which is a one shot monostable multivibrator circuit having the capability of retriggering itself. The event processor 38 has a time delay that is determined by an RC circuit 40 to which it is connected. Thus, the RC circuit 40 determines how long the event processor 38 remains energized after it is triggered or retriggered. The processor 38 has a trigger terminal $T_e$ and an output terminal $Q_e$. Normally, no signal exists at the terminal $Q_e$. However, once a pulse of the conditioned signal C reaches the trigger terminal $T_e$, the event processor 38 is energized and its output terminal $Q_e$ reverses condition so that a processor signal E appears at the terminal $Q_e$ (FIG. 3). The processor 38 will remain energized for a predetermined time after each pulse of the conditioned signal C, and the length of that time is dependent on the value of the resistance and the capacitance in the RC circuit 40. That time should be approximately one millisecond. However, since the frequency of the pulses in the conditioned signal C exceeds 20,000 hertz, more than one pulse occurs during the time delay of the processor 38, and this in turn causes the processor signal E to remain at the terminal $Q_e$ for as long as the conditioned signal C is received at the trigger terminal $T_e$. Indeed, the processor 38 remains energized not only for the duration of the conditioned signal C but also for an additional time, which in essence is equal to the time delay of the processor 38, and that is about one millisecond. If the conditioned signal C is considered an event, the processor signal E produced by the event processor 38 occupies that event and is representative of its duration.

The terminal $Q_e$ of the event processor 38 is connected to the other input terminal $A_L$; of the "and" gate 36. Thus the terminal $A_L$; of the "and" gate 36 acquires a signal contemporaneously with the commencement of the conditioned signal C. However, only after the digital counter 32 registers the requisite number of pulses does the "and" gate 36 energize and provide a pulsed signal F (FIG. 3) at its output terminal $A_o$, for it is only during the time that both the processor signal E and a pulse of the counter signal D exist contemporaneously at the output terminal $A_o$ of the "and" gate 36. Hence, the signal E from the "and" gate corresponds in time of occurance and duration to the counter signal D.

Not only does the event processor 38 provide one of two necessary signals for operation of the "and" gate 36, but it further triggers a flip flop 42 to which it is connected. The flip flop 42 possesses an input terminal $T_{fl}$ which is connected to the terminal $Q_e$ of the event processor 38. It also possesses an output terminal $Q_f$ which is connected with the reset terminal Pe of the digital counter 32. Normally, the output terminal $Q_f$ exists without a signal on it, and in this condition the counter 32 is reset to begin a new count. However, once the event processor 38 is energized, the polarity of the flip flop terminal $T_{fl}$ reverses and the output terminal $Q_f$ produces an enabling signal G that corresponds in time of occurance and duration to the processor signal E (FIG. 3). This signal is impressed on the reset terminal Pe of the digital counter 32, thereby enabling the counter 32 to count the pulses of the conditioned signal C supplied to it.

Both the output terminal $Q_f$ of the flip flop 42 and the output terminal $A_o$ of the "and" gate 36 are connected with another flip flop 44 at terminals $T_{g2}$ and $T_{g1}$, respectively, thereon. The flip flop 44 has an output terminal $Q_g$ which normally carries no signal. However, when both of its input terminals $T_{g1}$ and $T_{g2}$ receive signals, as is the case when both the "and" gate 36 and the event processor 38 are energized, the output terminal $O_g$ of the flip flop 44 produces a trigger signal H (FIG. 3) which remains for as long as the enabling signal G persists, that is for as long as the event processor 38 remains energized. Once the event processor 38 times out, its output terminal $Q_e$ reverses polarity as does the output terminal $Q_g$ of the flip flop 44. Thus, the flip flop 44 provides a single trigger signal H for each event that exceeds the minimum number of counts set into the counter 32. It thereby eliminates the possibility of successive pulses in the counter signal D and the "and" gate signal F from being considered as separate events by the remainder of the circuitry.

The trigger signal H derived from the flip flop 44 is transmitted to a duration timer 46 which is a one shot monostable multivibrator circuit that is retriggerable. Once the timer 46 is triggered, it remains energized for a predetermined time, and that time is controlled by an RC circuit 48 to which the duration timer 46 is connected. The RC circuit 48 contains a variable resistance 49 that is operated from the exterior of the housing 24, and enables one to vary the length of time that the timer 46 remains energized. The timer 46 has both a trigger terminal $T_t$ and an output terminal $Q_t$, the former of which is connected to the output terminal $Q_g$ of the flip flop 44 for receiving any signals H emitted by that circuit. Normally no signal exists at the input terminal $T_t$ in which case no signal exists at the output terminal $Q_t$. However, once the flip flop 44 changes condition and applies a trigger signal H to the input terminal $T_t$, the output terminal $Q_t$ of the duration timer 46 produces a duration or output signal I (FIG. 3) which remains for the length of time established by the RC circuit 48, and that time is substantially longer than the duration of the trigger signal H applied to the input terminal $T_t$. Indeed, the duration signal I persists for the time necessary to enable a blast of air issuing from the nozzel 14 to deflect a particle from the rebound trajectory b into the reject trajectory c, even if that signal does not occur at the proper time for achieving that end. The presence of the flip flop 44 prevents false triggering of the duration timer 46, so that the timer 46 is energized, at the most, only once for each event.

Then the output signal I produced by the duration timer 46 passes through an "or" gate 50 to the input terminal $I_d$ of a delay 52 which is a clock shift register having preferably 64 stages. The delay 52 is connected with a variable oscillator 54 such that each transition of the variable oscillator 54 will move the output signal one stage through the shift register circuit of the delay 52. Thus, 64 transitions of the oscillator 54 must occur before the output signal will appear at the output terminal $O_d$ of the delay 52 as a delayed signal J (FIG. 3), and the speed at which this occurs is dependent on the frequency of the oscillations produced by the oscillator 54. This oscillator 54 is in turn controlled by a variable resistor 56 such that the frequency of the oscillator 54 may be adjusted at the resistor 56. The delay 52 does not affect the duration of the output signal I produced by the duration timer 46, but does alter the time at which that signal reoccurs as the delayed signal J, delaying it until precisely the time at which that particle that caused the duration signal I in the first place is directly over the air nozzle 14 (FIG. 3). The variable resistor 56, which is operated from the exterior of the housing 24, permits precise adjustment of this time.

The delay 52 is connected with and operates a relay driver 58 which controls the air valve 16. The instant the relay driver 58 receives the delayed output signal J transmitted by the delay 52, it energizes the air valve 16 which remains energized for the duration of the output signal G. Of course, when the air valve 16 opens air issues from the air nozzle 14 at sufficient velocity to deflect a particle out of the rebound trajectory b and into the reject trajectory c. Large currents pass through the circuit of the relay driver 58 and to isolate these currents from the remainder of the circuitry for the control unit 22, an opto-isolator 60 is interposed between the delay 52 and the relay driver 58. The optoisolator 60 is also connected with a light-emitting diode 62 which illuminates each time the relay driver 60 is energized.

The comparator 30, the counter 32, the "and" gate 36, the event processor 38, the two flip flops 42 and 44, and the duration timer 46 together form a logic circuit that distinguishes amplified analogue signals B from each other, for only those signals which not only have oscillations in excess of the threshold voltage V for the comparator 30, but also have enough of those oscillations to meet the count set into the counter 32, produce an output or duration I signal. All other analogue signals B fail to produce any duration or output signal whatsoever. Duration signals I, of course, represent shell fragments and most other foreign matter, while the lack of duration signals represents nut meat.

Figure 4:
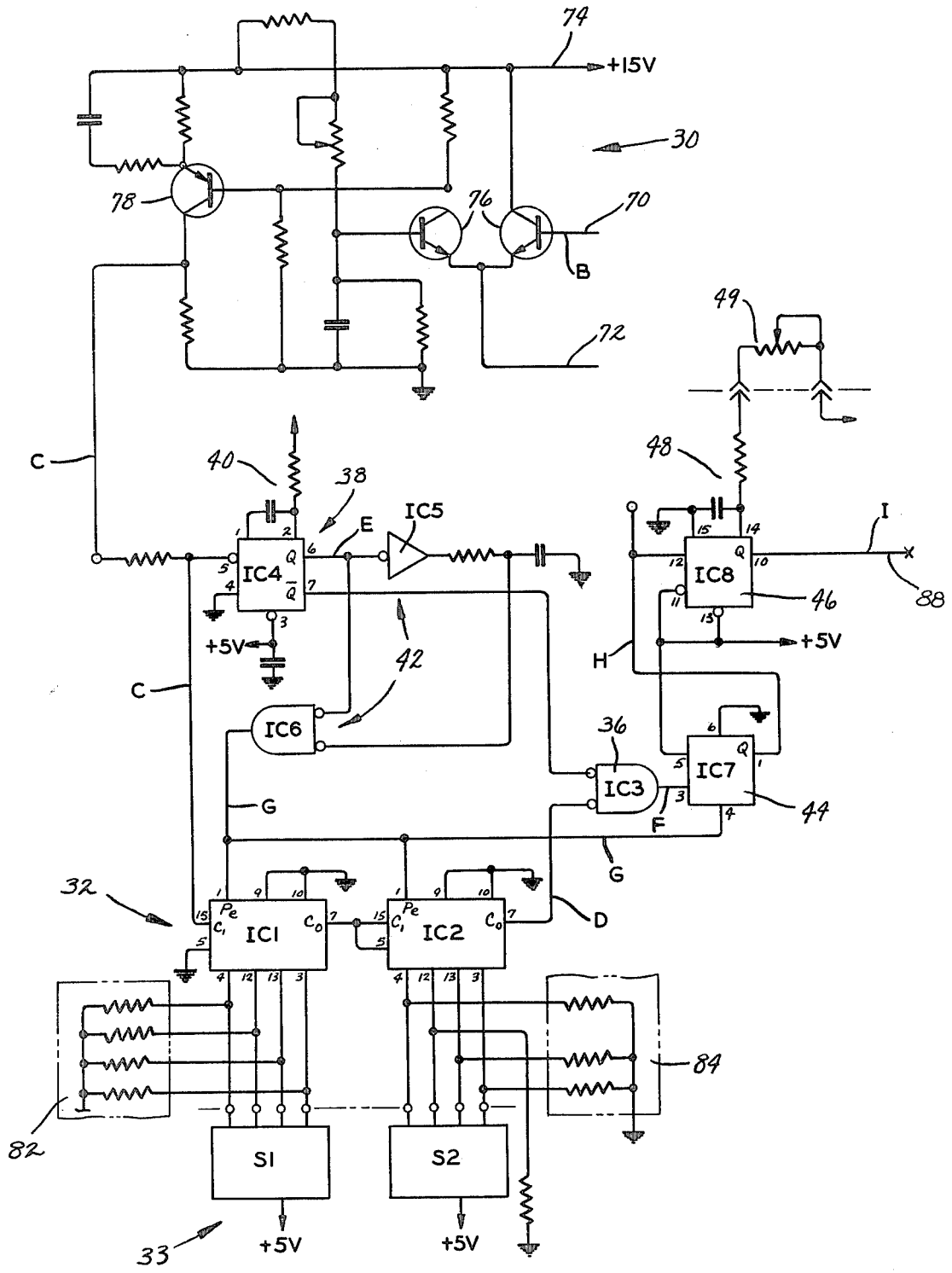
FIG. 4 is a schematic circuit diagram of the logic circuit in the control unit.

Referring now in more detail to the logic circuit (FIG. 4), the amplified analogue signal B from the variable gain amplifier 28 is supplied to the voltage comparator 30 through a lead 70, while the reference voltage V for the comparator 30 is supplied through another lead 72. In addition, the comparator 30 requires a source of electrical power, such as 15 V DC, and that is supplied through a power line 74. The comparator 30 itself includes a pair of NPN transistor triodes 76 which are connected together to form a push-pull amplifier, and an additional PNP transistor triode 78, as well as various resistances and capacitors all of which are connected as illustrated. The lead 72 through which the reference voltage V is supplied is connected to the emitters of the two triodes 76 that form part of the push-pull amplifier. The output or conditioned signal C is derived from the collector of the triode 78 and is transmitted to the digital counter 32 and the event processor 38.

The digital counter 32 consists of two integrated circuits IC1 and IC2 which are connected together such that the first counts the least significant digits, while the latter counts the most significant digits. For example, the circuit IC1 may count pulses from 1 to 9, while the circuit IC2 registers a decade of pulses each time the circuit IC1 exceeds nine counts. To this end, the lead through which the conditioned signal C is transmitted is connected to the input terminal $C_1$ of the circuit IC1, and the output terminal $C_o$ of that circuit is connected with the input terminal $C_1$ of the second circuit IC2. The circuit IC1 is further connected with a switch S1 and to a resistor network 82, while the circuit IC2 is connected to a switch S2 and a resistor network 84, all as illustrated. Both switches S1 and S2 are also connected to a 5V power supply. The switches S1 and S2 represent the thumb wheel switches 33 and establish the minimum pulse count at which the counter 32 will emit a counter signal D, with the switch S1 setting the least significant digit (e.g., 1–9) and the switch setting the most significant digit (e.g., decades). The counter signal D, if any occurs, is derived from the output terminal $C_o$ of the counter IC2. The integrated circuits IC1 and IC2 may be 34029 counters sold by The output terminal Co of the second integrated circuit IC2 for the counter 32 is connected to one of two input terminals of an integrated circuit IC3 which serves as the "and" gate 36. Actually the circuit IC3 is wired as a "nor" gate. It may be a 4001 integrated circuit sold by MOTOROLA.

The event processor 38 constitutes an integrated circuit IC4, such as a 14538 circuit sold by The circuit IC4 is connected with the triode 78 of the comparator 30 and with a 5V power supply and its own RC circuit 40 as illustrated. The output terminal $\overline{Q}$ of the circuit IC4 is connected directly to the second input terminal of the circuit IC3 that functions as the "and" gate 36. The other output terminal Q is connected to the flip flop 42.

The flip flop 42 includes two integrated circuits IC5 and IC6 wired together as illustrated, with the former serving as an inverter and the latter as a "nor" gate. Both circuits IC5 and IC6 may be on a single chip, along with the circuit IC3, and suited for this purpose is a 4001 circuit sold by MOTOROLA.

The output terminal of the circuit IC6 is coupled directly to the reset terminals Pe of the two counter circuits IC1 and IC2.

The flip flop 44 is another integrated circuit IC7 which may be a 4013 circuit sold by This circuit is connected directly to the output terminals of the circuit IC3, which functions as the "and" gate, and the output terminal of the circuit IC6, which is part of the flip flop 42, the connections being as illustrated.

The duration timer 46 constitutes still another integrated circuit IC8 which may be a 14538 circuit sold by MOTOROLA. Indeed, the integrated circuit IC8 may be on the same chip as the circuit IC4 for the event processor 38. In addition to being connected with the flip-flop 42, which triggers the circuit IC8 of the duration timer 46, the circuit IC8 is also connected with a 5V power supply and its RC circuit 48, all wired to it as illustrated. The duration signal I provided by the duration timer 46 appears at the output terminal Q of the circuit IC8 and is transmitted through a lead 88 to the "or" gate 50.

OPERATION

In use, the segregating machine S normally follows more conventional separating devices such as aspirators and shakers, but precedes the so-called picking table where the nut meat is subjected to visual inspection. It is designed primarily to remove shell fragments and foreign material which would otherwise have to be removed at a picking table.

The particles which include nut meat as well as shell fragments, pass down the trough between the rotating feed rolls 4, one after the other, and the rolls 4 discharge the particles individually, so that they move through the approach trajectory a. Since the sounding plate 6 is in the approach trajectory a, the particles impinge against the sounding plate 6, one after the other, and are deflected into the rebound trajectory b which passes over the air nozzle 16. Each time a particle strikes the sounding plate 6 it imparts acoustic vibrations to the sounding plate 6. These vibrations cause the crystal of the transducer 8 to expand and contract, and the transducer 8 in turn converts these expansions and contractions into a very weak electrical signal having the same frequency as the acoustic vibrations of the plate 6. Actually, the plate 6 will vibrate at several frequencies one of which is in the ultrasonic region. Moreover, the signal will change in amplitude to correspond to like changes in the amplitude of the accoustic vibrations.

The weak input signal from the transducer 8 passes through the coaxial cable 10 to the control unit 22 where it is amplified in the signal conditioner 26. The signal conditioner 26 further eliminates all signals having a frequency less than 20,000 hertz. The result is the analogue signal A (FIG. 3) which corresponds to the ultrasonic portion of the original signal. The analogue signal A passes on to the variable gain amplifier 28 where it is amplified still further to become the amplified analogue signal B, the amount of amplification being dependent on the setting of the rotary switches 24. Thereafter, the amplified analogue signal B enters the voltage comparator 30 where it is compared with the reference or threshold voltage V, the comparison being in the sense that the output of the comparator 30 reflects only those oscillations of the input signal B that exceed the threshold voltage V applied to the comparator 30. Those segments of the signal B are converted into electrical pulses which constitute the conditioned signal C applied to both the input terminal $C_1$ of the counter 32 and the trigger terminal $T_e$ of the event processor 38.

The conditioned signal C from the comparator 30 energizes the event processor 38 which remains energized for the duration of the conditioned signal C plus the time delay of the event processor 38. The event processor 38 in turn applies a positive voltage to one of the input terminals $A_L$ of the "and" gate 36 and further induces the flip-flop 42 to change condition so that its output terminal $Q_f$ produces an enabling signal G which is transmitted to the reset terminal Pe of the counter 32.

The conditioned signal C also passes into the counter 32, and inasmuch as its reset terminal Pe is subjected to the enabling signal G, the counter 32 is in condition to count the pulses of the conditioned signal C. This it does, and if the conditioned signal C contains sufficient pulses to meet the minimum count set into the digital counter 32 at its thumbwheel switches 33, the output terminal $C_o$ of the counter 32 will produce a counter signal D which energizes the other input terminal $A_L$ of the "and" gate 36, enabling the output terminal $A_o$ of the "and" gate 36 to produce a signal F. Thus, if the conditioned signal C possesses the requisite number of pulses, which means that the original signal B possessed enough oscillations having an amplitude in excess of a threshold level, the "and" gate 36 will be energized. This is the case with shell fragments and other foreign material such as metal, glass, wood, and the like. On the other hand, if the conditioned signal C does not possess enough peaks to meet the minimum requirement of the counter 32, which means the amplified analogue signal B had no peaks in excess of the threshold or not enough peaks in excess of the threshold, then no signal will appear at the output terminal $C_o$ of the counter 32 so the "and" gate 36 will not be energized. In other words, only shell fragments, foreign particles, and the like, will meet the minimum requirements of the comparator 30 and counter 32 and thereby cause the counter 32 to produce a counter signal D that is capable of energizing the "and" gate 36.

Assuming that the conditioned signal C possesses sufficient pulses to activate the "and" gate 36, then the flip flop 44 changes condition, since both of its input terminals $T_g$ receive the necessary signals F and G to effect such a change. This in turn produces a signal H at the trigger terminal $T_d$ of the duration timer 46, which remains energized and produces a duration signal I for the time established by its associated RC circuit 48. That time may be varied by adjusting the variable resistor 49, and indeed, the adjustment should be such that the duration timer 46 remains energized long enough to enable an air blast from the nozzle 14 to deflect the particle that caused the signal from the rebound trajectory b into the reject trajectory c.

The duration signal I that emanates from the duration timer 46 passes through the "or" gate 50 to the delay 52 where it is delayed by a time that is dependent on the setting of the variable resistor 56 that conrols the oscillator 54 for the delay 52. The delayed signal J after passing through the optoisolator 60, energizes the relay driver 58 which in turn opens the air valve 16. The lag imparted to the duration signal I by the delay 52 is sufficient to afford the particle time enough to pass over the air nozzle 14 so that when the air valve 16 is energized, the air stream issuing from it will be directed at the particle. The duration of the air blast, which is controlled by the duration timer 46 and the variable resistor 49 associated with it, is sufficient to propel the particle fully into the reject trajectory c.

As a consequence of the control unit 22 located between the sounding plate 6 and the air valve 16, nut meats after deflecting from the sounding plate 6 continue on in the rebound trajectory b. However, shell fragments and other foreign materials which induce analogue signals B that both meet the threshold voltage V of the comparator 30 and the minimum count of the counter 32 cause the air valve 16 to energize, and hence these particles are directed into the reject trajectory c by the air nozzle 14. In short, the control unit 22, by analyzing the vibrations produced in the sounding plate 6, segregates the nut meat from the shell fragments and other foreign particles so that those particles which are collected at the terminal end of the rebound trajectory b constitute only nut meat.

MODIFICATION

The versatility of the control unit 22 may be increased by introducing an extend circuit between the signal conditioner 26 and the "or" gate 50. This circuit extends the duration of the air blast for particles that produce analogue signals B having extremely large amplitude. This enables heavier foreign particles, such as metal objects, to be deflected from the rebound trajectory and into the reject trajectory c with greater force than the lighter shell fragments.

The extend circuit includes (FIG. 2) a comparator 90 which is identical to the comparator 30, only its input terminal $I_m$ is connected with the output terminal of the signal conditioner 26 ahead of the variable gain amplifier 28. Also, the reference terminal Rm of the comparator 90 is connected to a voltage source through a potentiometer 92 so that the reference voltage Vm applied to the comparator 66 may be varied. The voltage comparator 66 also includes a control terminal $U_m$ which is connected to a switch 94 capable of grounding that terminal. When the control terminal $U_m$ is grounded, the extend circuit is rendered inoperative so that all of the signals for operating the air nozzle 14 are derived exclusively from the logic circuit. However, when the extend switch 94 is open, the pulses generated by the voltage comparator 90 exists at the output terminal of the voltage comparator 90. Since the reference terminal Rm of the voltage comparator 90 is connected to a voltage source through the potentiometer 92, the threshold voltage $V_m$ of the supply to the comparator 90 may be varied. The threshold voltage $V_m$ applied to the comparator 90 is such that the amplitudes which exceed it are greater than the amplitudes in the signal A which will cause the comparator 30 to provide a conditioned signal C. The voltage comparator 90 produces pulses much the same as the voltage comparator 30, and the pulses derived from the voltage comparator 90 constitute a second conditioned signal K (FIG. 3). Thus, for each conditioned signal K in the extend circuit, a conditioned signal C exists in the logic circuit, but the reverse does not hold true.

The second conditions signal k enters the trigger terminal Tn of an extend processor 96 which is a one-shot monostable multivibrator circuit that is retriggerable. Once the extend processor 96 receives the leading pulse, it energizes so that its output terminal Qn produces an extend signal L (FIG. 3), the duration of which is controlled by an RC circuit 98 containing a variable resistor 100. By changing the magnitude of the resistor 100, one may vary the time delay, which is the time that the processor 96 will remain energized after the commencement of the last pulse. In any event, this time is longer than the duration signal I produced by the duration timer 46. The extend signal L passes through the "or" gate 50 where it overrides or extends the duration signal I. It then enters the delay 52, through which it is transmitted to the relay driver 58 as a delayed signal M which energizes the air valve 16. The duration of the air blast thus depends on the time for which the extend processor 94 remains energized.

In lieu of an air blast to affect the final separation, other devices may be employed - for example, a movable deflector plate. Also the utility of the apparatus S is not confined exclusively to segregating nut meat from shell fragments. It may be used to segregate just about any type of commingled particles, as long as the various types of particles produce vibrations that are capable of being distinguished in the control unit 22. For example, it may be used to separate pitted olives from those containing pits.

This invention is intended to cover all changes and modifications of the example of the invention herein chosen for purposes of the disclosure which do not constitute departures from the spirit and scope of the invention.

What is claimed is:

1. An apparatus for separating comingled solid particles, said apparatus comprising: a sounding plate against which the particles are directed one at a time, whereby the individual particles impart mechanical vibrations to the sounding plate with the vibrations produced by like particles being similar in frequency and decay; means for converting the vibrations produced in the sounding plate by each particle into an electrical input signal that oscillates at the frequency of the vibrations and undergoes changes in amplitude that correspond to changes in the amplitude of the vibrations; logic means for analyzing the input signal as to the oscillations which exceed a prescribed threshold amplitude and for producing an output signal which distinguishes those input signals that have a prescribed number of oscillations exceeding the threshold amplitude from those input signals which do not, so that the particles after striking the sounding plate may be separated on the basis of output signals derived from the logic means.

2. An apparatus according to claim 1 and further comprising reject means responsive to output signals produced by the logic means for separating those particles which cause output signals from the remaining particles which do not produce output signals.

3. An apparatus according to claim 2 wherein the particles move toward the sounding plate along an approach trajectory and after striking the plate, move away from it along a rebound trajectory; and wherein the reject means separates the particles by diverting from the rebound trajectory those particles which cause output signals.

4. An apparatus according to claim 3 wherein the reject means includes an air nozzle located along the rebound trajectory and oriented generally transversely with respect to it and an air valve separating the air nozzle from a source of high pressure air, the air valve being connected to the logic means such as to operate in response to output signals produced by the logic means, whereby air will issue from the nozzle when the air valve opens so as to deflect particles located opposite the air nozzle out of the rebound trajectory and into a reject trajectory.

5. An apparatus according to claim 1 wherein the logic means includes a voltage comparator which converts those oscillations of input signal which exceed a threshold voltage corresponding to the threshold amplitude into pulses, and a counter that counts the pulses and produces a counter signal when the number of pulses exceeds the prescribed number of oscillations.

6. An apparatus according to claim 5 wherein the logic means further comprises duration means for producing the output signal in response to a counter signal and for further controlling the duration of the output signal.

7. An apparatus according to claim 6 and further comprising means for delaying the output signal produced by duration means.

8. An apparatus according to claim 5 and further comprising an amplifier for amplifying the input signal prior to the comparator, the amplifier having a variable gain.

9. An apparatus according to claim 1 and further comprising filter means for eliminating all oscillations in the input signal below a prescribed frequency.

10. An apparatus according to claim 9 wherein the prescribed frequency is in the ultrasonic range of frequencies.

11. A process for segregating commingled particles into groups having like characteristics, said process comprising directing the particles one at a time against a sounding plate, whereby the impact of each particle against the sounding plate imparts mechanical vibrations to the sounding plate; converting the vibrations produced by each particle into an electrical input signal that oscillates at the same frequency as the vibrations and undergoes changes in amplitude that correspond to changes in amplitude of the vibrations; and producing an output signal that distinguishes those input signals having a prescribed number of oscillations that exceed a threshold amplitude from those input signals that do not.

12. The process according to claim 11 and further comprising filtering out any frequencies in the input signal that are less than a prescribed frequency.

13. The process according to claim 12 wherein the prescribed frequency is in the ultrasonic range of frequencies.

14. The process according to claim 11 wherein the step of producing an output signal comprises: converting those oscillations of the input signal which exceed the threshold amplitude into pulses, counting the pulses, and creating the output signal when the number of pulses exceeds the prescribed number of oscillations.

15. The process according to claim 14 and further comprising producing an interim signal when the number of pulses exceeds the prescribed number of oscillations, and producing the output signal in response to the interim signal, the output signal being of predetermined duration.

16. The process according to claim 14 and further comprising actuating a reject device with the output signal, the reject device being capable of separating those particles which cause an output signal from those that do not.

17. The process according to claim 11 wherein the particles are directed toward the plate along an approach trajectory and after striking the plate, leave it along a rebound trajectory, and further comprising delaying the output signal until the particle that caused it is at a predetermined location along the rebound trajectory, and initiating a blast of air with the output signal to deflect the particle out of the rebound trajectory and into a reject trajectory.

18. An apparatus for segregating comingled solid particles, said apparatus comprising: a sounding plate against which the particles are directed one at a time, the plate being such that it will produce ultrasonic vibrations in excess of 20,000 Hz upon being struck by a particle; and means for analyzing ultrasonic vibrations imparted to the sounding plate as a result of a particle striking it and for producing an output signal in response to ultrasonic vibrations that have a predetermined number of oscillations exceeding a prescribed amplitude.

* * * * *